US005988184A

United States Patent [19]

Shu

[11] Patent Number: 5,988,184

[45] Date of Patent: Nov. 23, 1999

[54] DEVICE FOR STYLING HAIR

[76] Inventor: Ying Jen Shu, No. 96, Lane 349, Chung Cheng South Road, Yung Kang, Tainan Hsien, Taiwan, 710

[21] Appl. No.: 09/273,737

[22] Filed: Mar. 22, 1999

[51] Int. Cl.[6] ..... A45D 8/20; A45D 8/04; A45D 8/00; A45D 7/02

[52] U.S. Cl. ..... 132/277; 132/273; 132/129; 132/276; 132/212; 132/219

[58] Field of Search ..... 132/277, 276, 132/278, 279, 273, 275, 259, 260, 144, 145, 146, 151, 152, 126, 107, 219, 213.1, 212, 129, 130, 131, 132

[56] References Cited

U.S. PATENT DOCUMENTS

| | | | |
|---|---|---|---|
| 1,595,595 | 8/1926 | Bonat et al. | 132/129 |
| 2,100,538 | 11/1937 | Copenhefer | 132/129 |
| 4,414,992 | 11/1983 | Russell | 132/129 |
| 5,285,774 | 2/1994 | Stachurski | 132/129 |
| 5,449,007 | 9/1995 | Arnhols | 132/136 |
| 5,533,533 | 7/1996 | Shing | 132/279 |

*Primary Examiner*—John J. Wilson
*Assistant Examiner*—Robyn Doan
*Attorney, Agent, or Firm*—Charles E. Baxley, Esq.

[57] ABSTRACT

A device for styling hair includes a pair of plates pivotally coupled together at a middle shaft. A pair of combs are pivotally coupled to the lower portions of the plates for allowing the combs to be rotated downward of the plates and to be rotated inward between the plates. The combs each includes a number of outward extended comb teeth for styling the hair. The plates each includes a pair of sleeves disposed in the lower portion. The combs each includes two pins rotatably engaged in the sleeves for pivotally coupling the combs to the plates.

7 Claims, 6 Drawing Sheets

DEVICE FOR STYLING HAIR

BACKGROUND OF THE INVENTION

1. Field of the Invention

The present invention relates to a device and more particularly to a device for styling hair.

2. Description of the Prior Art

Typical hair barrettes or hair clips comprise a base and a loop pivotally coupled together at one end and detachably secured together at the other end. The base may not be easily used as the comb for styling the hair.

The present invention has arisen to mitigate and/or obviate the afore-described disadvantages of the conventional hair barrettes.

SUMMARY OF THE INVENTION

The primary objective of the present invention is to provide a device for styling the hair which includes a pair of combs pivotally secured to two clasp plates for clasping the braid of hair and for allowing the combs to be used for styling the hair.

In accordance with one aspect of the invention, there is provided a device for styling hair comprising a pair of plates including a middle portion pivotally coupled together at a pivot shaft, the plates each including an upper portion and a lower portion, means for biasing the lower portions of the plates toward each other, and a pair of combs including a base pivotally coupled to the lower portions of the plates respectively for allowing the combs to be rotated outward of the plates and to be rotated inward between the plates, the combs each including a plurality of comb teeth extended from the base for styling the hair.

The lower portions of the plates each includes a pair of sleeves, the bases of the combs each includes two ends each having a pin rotatably engaged in the sleeves for pivotally coupling the combs to the plates. The sleeves of the plates each includes an inner portion having a groove formed therein for allowing the pins to be engaged into the sleeves. The sleeves of the plates each includes a stop extended downward therefrom for engaging with the combs and for preventing the combs from rotating outward relative to the plates.

The lower portions of the plates each includes a stop means for engaging with and for limiting a relative rotational movement of the combs to the plates. The comb teeth of the combs are curved. The combs each includes a plurality of projections extended outward therefrom for engaging with the hair when the combs are folded inward between the plates.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
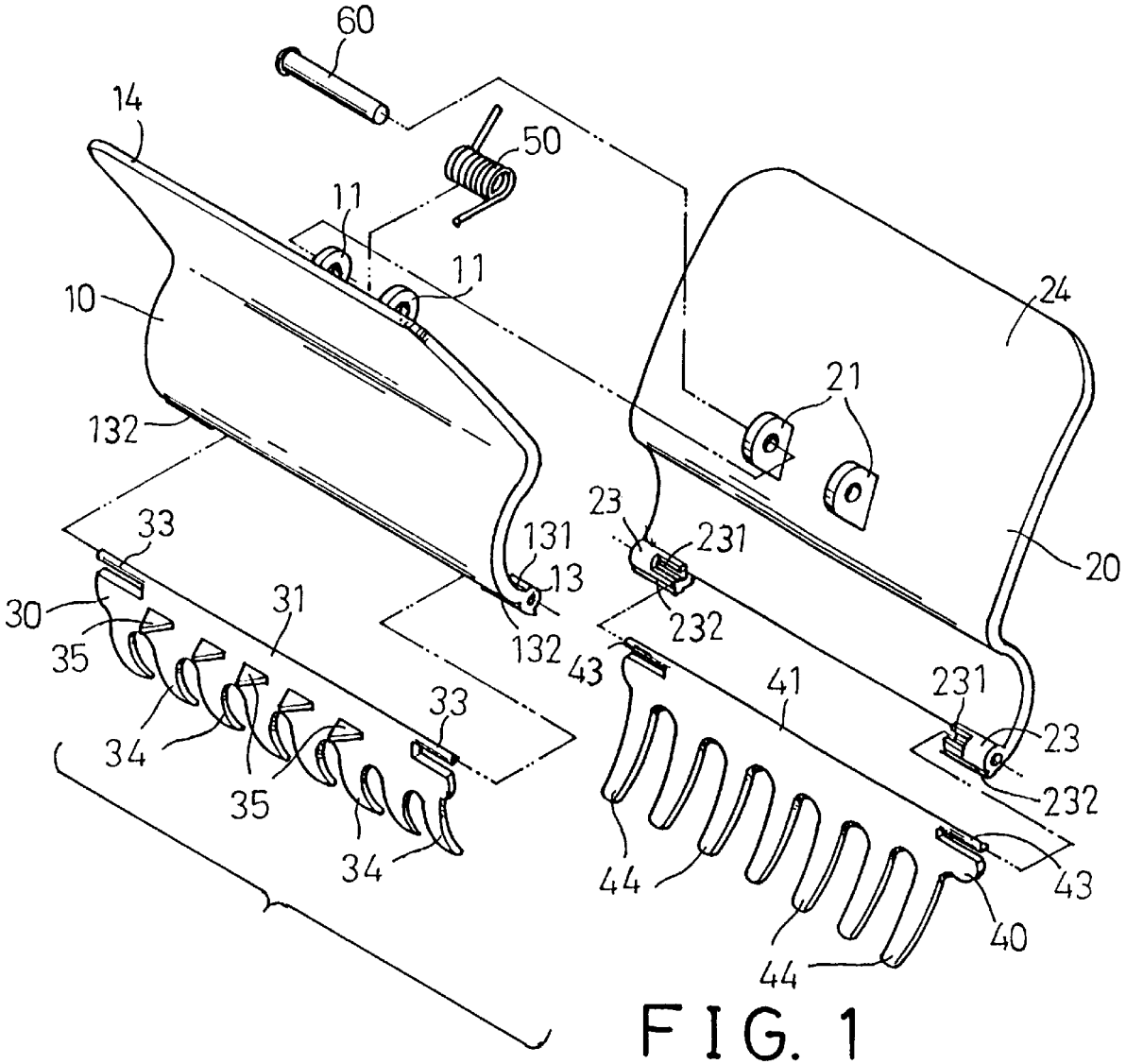
FIG. 1 is an exploded view of a device for styling hair in accordance with the present invention.
Figure 2:
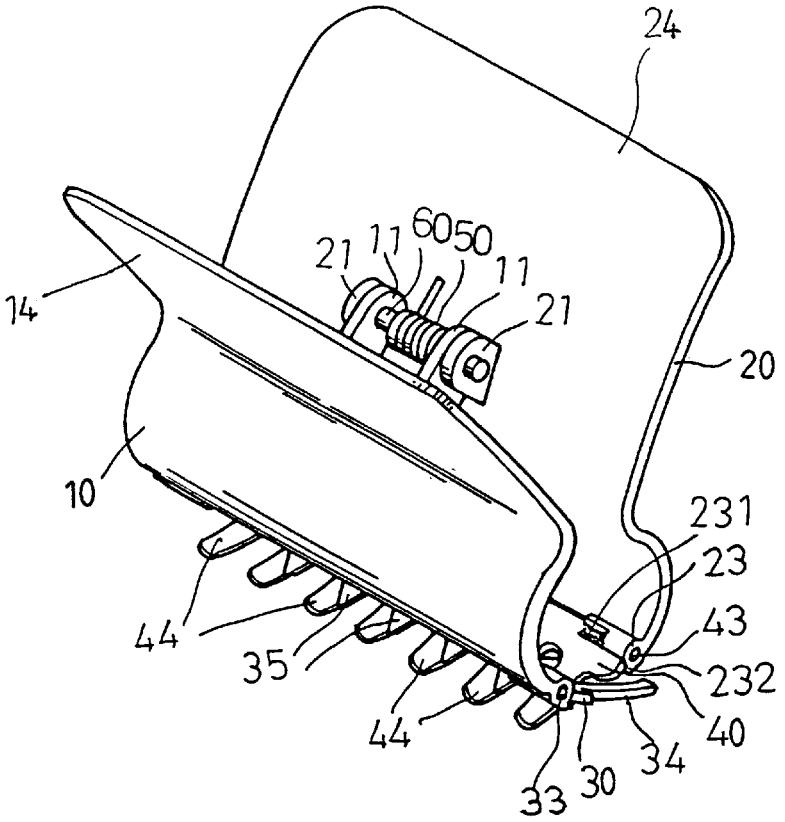
FIG. 2 is a perspective view of the device.

Referring to the drawings, and initially to FIGS. 1 and 2, a hair styling device in accordance with the present invention comprises a pair of clasp plates 10, 20 each having a pair of ears 11, 21 extended from the middle portion for rotatably receiving a shaft 60 and for allowing the plates 10, 20 to be pivotally coupled together at the shaft 60. The plates 10, 20 each includes a handle 14, 24 formed in the upper portion and each includes a pair of spaced sleeves 13, 23 provided in the lower port ion. A spring 50 is engaged on the shift 60 and engaged with the plates 10, 20 for biasing the handles 14, 24 of the plates 10, 20 away from each other and for biasing the sleeves 13, 23 toward each other. The sleeves 13, 23 each includes an inner end having a groove 131, 231 formed therein and each includes a stop 132, 232 extended downward therefrom. The stops 132, 232 may also be directly extended from the plates 10, 20 instead of being extended from the sleeves 13, 23.

Figure 7:
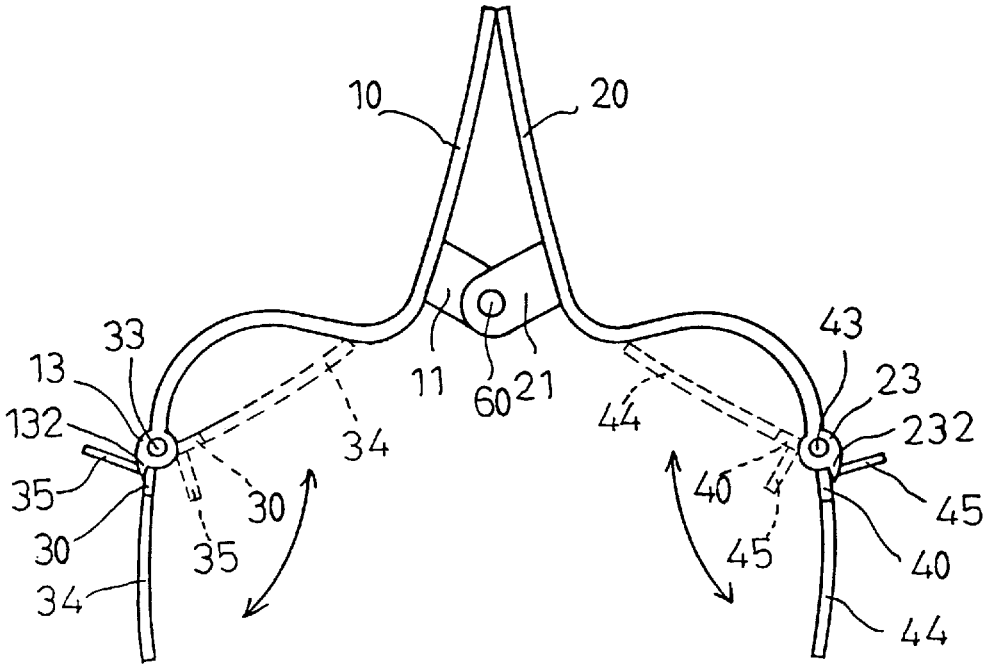
FIGS. 7, 8, 9, 10 are side views illustrating the operation of the hair styling device.
Figure 5:
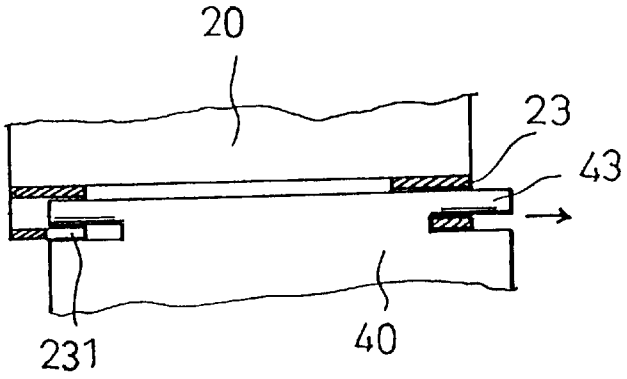
FIGS. 3, 4, 5, 6 are schematic views illustrating the coupling of the combs to the plates.
Figure 9:
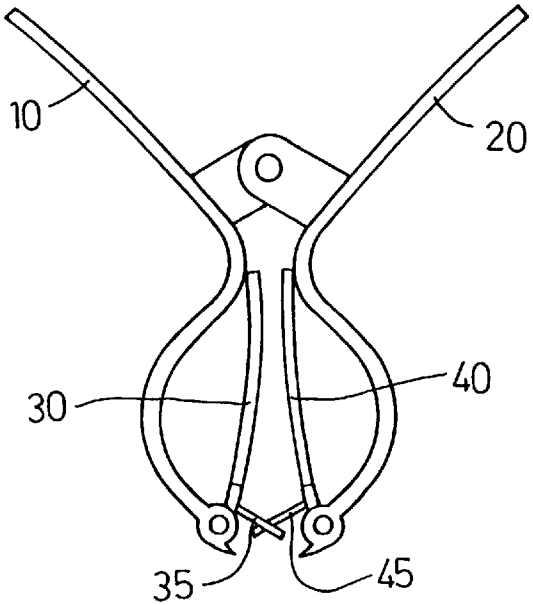
Figure 10:
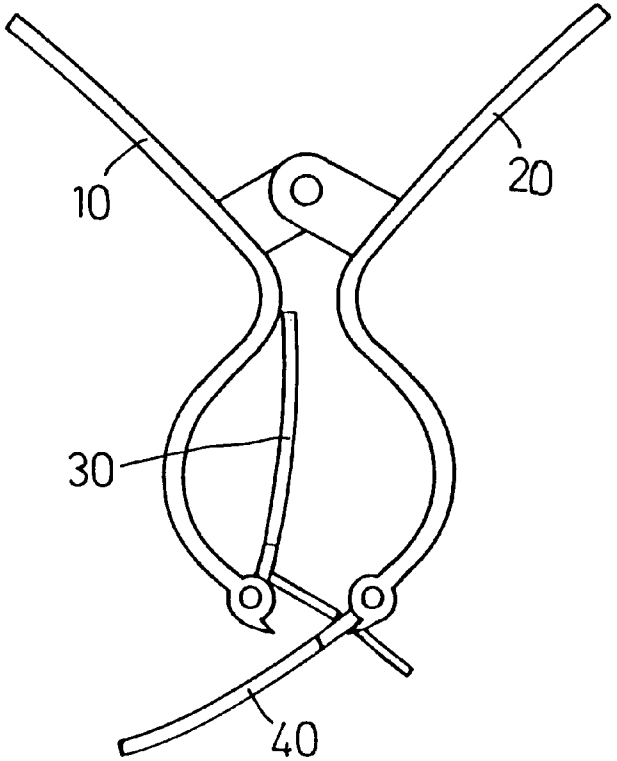

Two combs 30, 40 each includes a base 31, 41 having a pin 33, 43 provided in each of the two ends thereof for rotatably engaging into the sleeves 13, 23 of the plates 10, 20 and for allowing the combs 30, 40 to be pivotally coupled to the plates 10, 20 respectively. The combs 30, 40 each includes a number of comb teeth 34, 44 extended downward therefrom and having a curved structure, and each includes a number of projections 35, 45 extended outward and substantially perpendicular to the respective combs 30, 40. The stops 139, 232 of the sleeves 13, 23 are provided for engaging with the combs 30, 40 (FIGS. 7, 8) and for limiting the relative rotational movement of the combs 30, 40 to the plates 10, 20 and for preventing the combs 30, 40 from rotating downward and outward relative to the plates 10, 20 (FIGS. 7, 8) and for allowing the combs 30, 40 to be folded inward from the position as shown in solid lines in FIG. 7 to the position as shown, in dotted lines in FIG. 7 to engage with the plates (FIGS. 9, 10).

Figure 6:
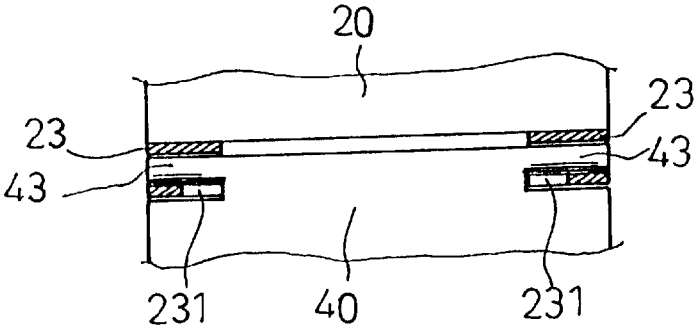
Figure 3:
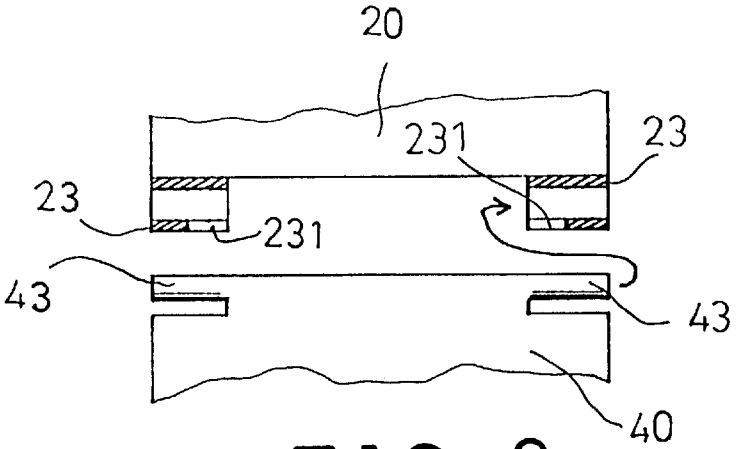
Figure 4:
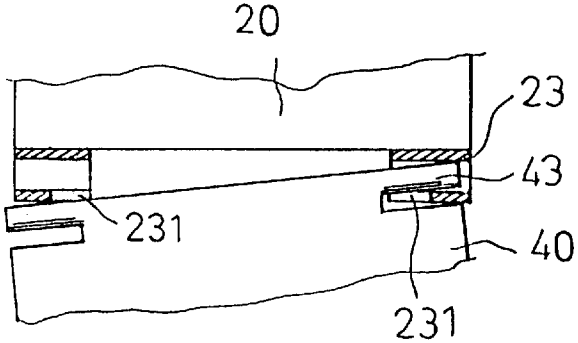

Referring next to FIGS. 3–6, one of the pins 33, 43 of the combs 30, 40 may each engaged into the sleeve 13, 23 of the plate 10, 20 (FIGS. 4, 5) before the other pin 33, 43 may be engaged into the other sleeve 13, 23 (FIG. 6). The sleeves 13, 23 may further include a bulge or the like for engaging with and for preventing the pins 23, 33 from being disengaged from the sleeves 13, 23.

Figure 11:
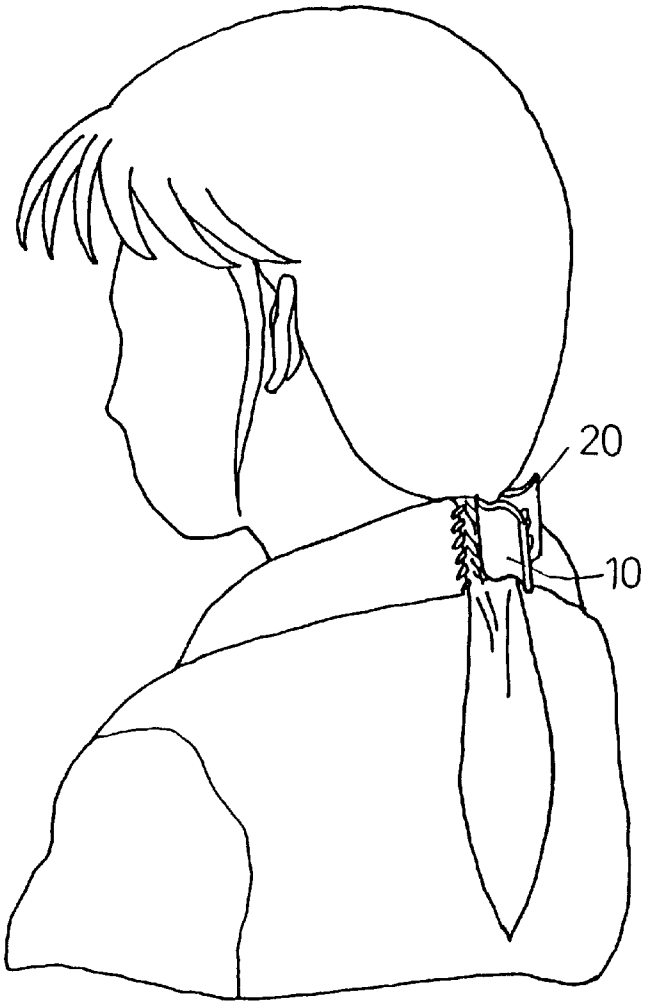
FIGS. 11, 12, 13 are schematic views illustrating the operation of the hair styling device with the hair.
Figure 8:
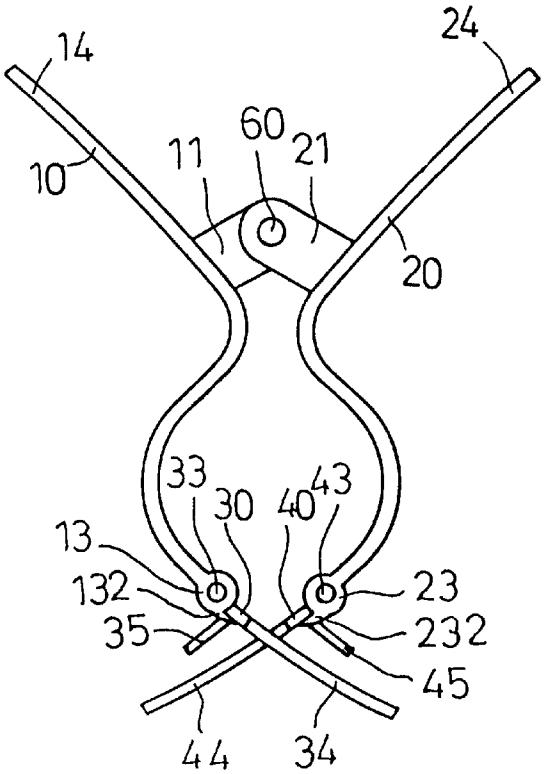
Figure 12:
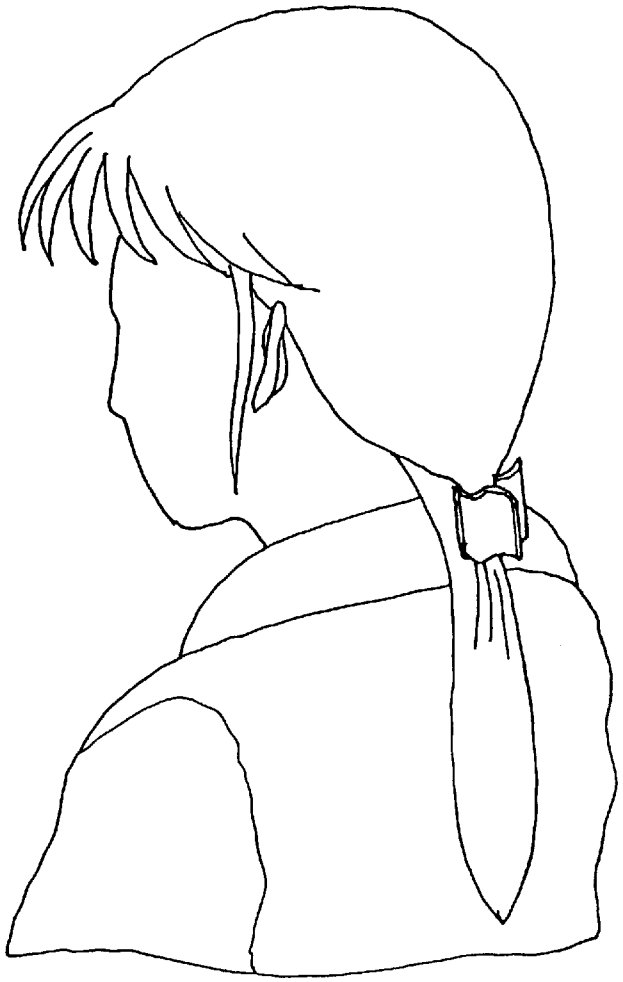
Figure 13:
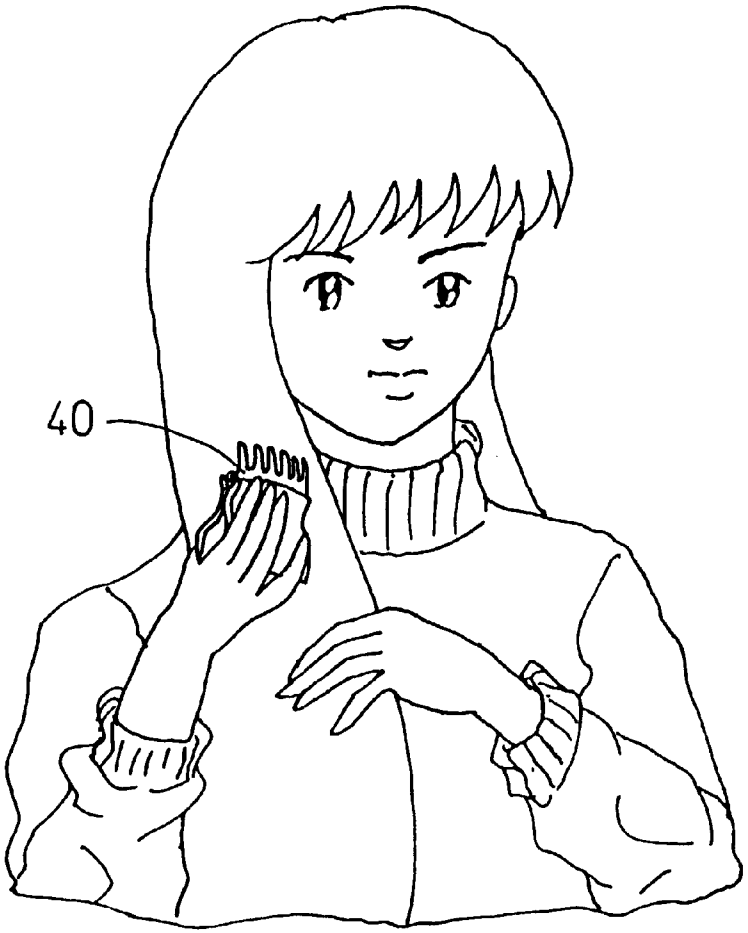

In operation, as shown in FIGS. 8 and 11, the combs 30, 40 may be folded or rotated outward of the plates 10, 20 to the outward or downward working position for engaging with and for stable clasping the braid of hair in place. As shown in FIGS. 9 and 12, the combs 30, 40 may also be folded inward for allowing the braid of hair to be clasped in place by the combs 30, 40 and the projections 35, 45 of the combs 30, 40. As shown in FIGS. 10 and 13, when the comb 30 is folded inward between the plates 10, 20, the other comb 40 may now be used as the comb for styling the hair.

Accordingly, the hair styling device in accordance with the present invention includes a pair of combs pivotally secured to two clasp plates for clasping the braid of hair and for allowing the combs to be used for styling the hair.

Although this invention has been described with a certain degree of particularity, it is to be understood that the present dislosure has been made by way of example only and that numerous changes in the detailed construction and the combination and arrangement of parts may be resorted to without departing from the spirit and scope of the invention as hereinafter claimed.

I claim:

1. A device for styling hair comprising:

a pair of plates including a middle portion pivotally coupled together at a pivot shaft, said plates each including an upper portion and a lower portion, means for biasing said lower portions of said plates toward each other, and a pair of combs pivotally coupled to said lower portions of said plates respectively for allowing said combs to be rotated outward of said plates and to be rotated inward between said plates, said combs each including a plurality of comb teeth extended therefrom for styling the hair.

2. The device according to claim 1, wherein said lower portions of said plates each includes a pair of sleeves, said combs each includes a base pivotally coupled to said lower portions of said plates, said bases of said combs each includes two ends each having a pin rotatably engaged in said sleeves of said plates for pivotally coupling said combs to said plates.

3. The device according to claim 2, wherein said sleeves of said plate each includes an inner portion having a groove formed therein for allowing said pins to be engaged into said sleeves.

4. The device according to claim 2, wherein said sleeves of said plates each includes a stop extended downward therefrom for engaging with said combs and for preventing said combs from rotating outward relative to said plates.

5. The device according to claim 1, wherein said lower portions of said plates each includes a stop means for limiting a relative rotational movement of said combs to said plates.

6. The device according to claim 1, wherein said comb teeth of said combs are curved.

7. The device according to claim 1, wherein said combs each includes a plurality of projections extended outward therefrom for engaging with the hair when said combs are folded inward between said plates.

* * * * *